US011067925B2

(12) United States Patent
Cao et al.

(10) Patent No.: US 11,067,925 B2
(45) **Date of Patent: *Jul. 20, 2021**

(54) HEATER MEMBER FOR THE FUSER ASSEMBLY OF AN ELECTROPHOTOGRAPHIC IMAGING DEVICE

(71) Applicant: LEXMARK INTERNATIONAL, INC., Lexington, KY (US)

(72) Inventors: Jichang Cao, Lexington, KY (US); Alexander Johannes Geyling, Lexington, KY (US); Russell Edward Lucas, Lexington, KY (US)

(73) Assignee: LEXMARK INTERNATIONAL, INC., Lexington, KY (US)

( * ) Notice: Subject to any disclaimer, the term of this patent is extended or adjusted under 35 U.S.C. 154(b) by 161 days.

This patent is subject to a terminal disclaimer.

(21) Appl. No.: 16/288,641

(22) Filed: Feb. 28, 2019

(65) Prior Publication Data

US 2019/0196372 A1 Jun. 27, 2019

Related U.S. Application Data

(63) Continuation of application No. 14/866,278, filed on Sep. 25, 2015, now Pat. No. 10,274,876.

(51) Int. Cl.

| | |
|---|---|
| ***G03G 15/20*** | (2006.01) |
| ***H01C 7/00*** | (2006.01) |
| ***H01C 13/02*** | (2006.01) |

(52) U.S. Cl.

CPC ..... *G03G 15/2039* (2013.01); *G03G 15/2053* (2013.01); *H01C 7/008* (2013.01); *H01C 13/02* (2013.01); *G03G 2215/2035* (2013.01)

(58) Field of Classification Search

None

See application file for complete search history.

(56) References Cited

U.S. PATENT DOCUMENTS

| | | | | |
|---|---|---|---|---|
| 7,228,082 | B1 | 6/2007 | Davidson | |
| 2002/0094212 | A1 * | 7/2002 | Suzumi | G03G 15/2042 399/69 |

(Continued)

FOREIGN PATENT DOCUMENTS

| | | |
|---|---|---|
| EP | 0984339 B1 | 7/2007 |

*Primary Examiner* — Joseph M. Pelham

(57) ABSTRACT

A fusing apparatus includes a substrate having a first surface and a second surface, the second surface being opposite the first surface on the substrate, a first resistive trace and a second resistive trace, the first and second resistive traces being disposed adjacent each other along the first surface of the substrate in a length-wise direction thereof. A resistance of the first resistive trace is less than a resistance of the second resistive trace. The fusing apparatus further includes a plurality of thermistors disposed along the second surface of the substrate, including a first thermistor disposed on the second surface of the substrate opposite the first resistive trace in a central location along the length of the first resistive trace, a second thermistor disposed on the second surface of the substrate opposite the second resistive trace in a central location along the length of the second resistive trace, and a third thermistor disposed on the second surface of the substrate opposite a first area of the second surface, the third thermistor being closer to a first length-wise end of the substrate than the second resistive trace and a first length-wise end of the first resistive trace being closer to the first length-wise end of the substrate than the third thermistor.

16 Claims, 8 Drawing Sheets

(56) References Cited

U.S. PATENT DOCUMENTS

| | | | | |
|---|---|---|---|---|
| 2007/0059001 | A1* | 3/2007 | Matsuura | G03G 15/2042 399/45 |
| 2008/0298824 | A1* | 12/2008 | Kanno | G03G 15/2039 399/33 |
| 2013/0039674 | A1* | 2/2013 | Takami | G03G 15/2017 399/69 |
| 2013/0236202 | A1* | 9/2013 | Akiya | G03G 15/2017 399/69 |
| 2015/0055968 | A1* | 2/2015 | Kadowaki | G03G 15/2039 399/69 |
| 2015/0086231 | A1 | 3/2015 | Bush | |
| 2017/0102650 | A1* | 4/2017 | Shimura | G03G 15/2053 |
| 2018/0088501 | A1* | 3/2018 | Maeda | G03G 15/205 |
| 2019/0196372 | A1* | 6/2019 | Cao | G03G 15/2053 |

* cited by examiner

HEATER MEMBER FOR THE FUSER ASSEMBLY OF AN ELECTROPHOTOGRAPHIC IMAGING DEVICE

CROSS REFERENCES TO RELATED APPLICATIONS

The present application is a continuation application of U.S. application Ser. No. 14/866,278, filed Sep. 25, 2015, having the same title, which in turn claimed priority under 35 U.S.C 119(e) from U.S. provisional application 62/194,797, filed Jul. 20, 2015 and entitled, "Fuser Assembly Having Dual Power Heater," the content of which is hereby incorporated by reference herein in its entirety.

STATEMENT REGARDING FEDERALLY SPONSORED RESEARCH OR DEVELOPMENT

None.

REFERENCE TO SEQUENTIAL LISTING, ETC.

None.

BACKGROUND

1. Field of the Disclosure

The present disclosure relates generally to fusing toner to sheets of media, and particularly to a heater and heating method for the fuser assembly of a printing device that provides for better heating control while reducing flicker and harmonic noise.

2. Description of the Related Art

As printer speeds increase, fusing power to fuse toner to sheets of media increase. Existing 1200 W fuser heaters used in color electrophotographic imaging devices are not able to deliver enough power for maintaining the needed fusing temperatures at 70 pages per minute (ppm). To fuse 70 ppm in a color imaging device, heater power would need to increase to roughly 1450 W or higher in order to robustly maintain fusing temperatures and achieve required fusing quality for all possible operating conditions.

An issue for a fuser heater with power higher than 1200 W is meeting flicker and harmonics requirements of the International Electrotechnical Commission (IEC). When a high power fuser heater is turned on, light bulbs flicker in the room in which the imaging device is located if the light fixtures are on the same branch circuit as the imaging device. To reduce the severity of light flicker and achieve relatively tight temperature control requirements due to a relatively small fusing temperature window, phase control of AC power is used to adjust heating power by changing the phase angle or phase time delay for each AC half cycle. For fuser heaters having a single resistor trace for generating heat, flicker and harmonics generated by the fuser heater during a fusing operation is directly related to fuser heater power. Higher power levels will thus worsen flicker and harmonics effects. Fuser heater power levels at about 1200 W in current imaging devices are very close to the power limit that can pass flicker and harmonics tests at 70 ppm print speeds. Even for a 1200 W fuser heater, considerations exist to sacrifice temperature control performance and allow fuser heater temperatures to vary significantly around its heater set point in order to pass flicker and harmonics requirements. Because fusers for color laser printers typically have very small operating windows, it is very challenge for a 1200 W fuser heater to achieve tight temperature windows while passing flicker/harmonics tests. Fuser assemblies having 1300 W or 1450 W fuser heaters further increase the challenges.

SUMMARY

Example embodiments of the present disclosure overcome shortcomings in existing fusing systems. In accordance with a first embodiment, there is disclosed a fusing apparatus including a substrate having a first surface and a second surface, the second surface being opposite the first surface on the substrate; and a plurality of resistive traces disposed along the first surface of the substrate, including a first resistive trace and a second resistive trace. The first and second resistive traces are disposed adjacent each other along the first surface of the substrate in a length-wise direction thereof and are located within the fusing nip. A resistance of the first resistive trace is less than a resistance of the second resistive trace. The fusing apparatus further includes a plurality of thermistors disposed along the second surface of the substrate, including a first thermistor disposed on the second surface of the substrate opposite the first resistive trace, a second thermistor disposed on the second surface of the substrate opposite the second resistive trace, and a third thermistor disposed on the second surface of the substrate opposite, the third thermistor being closer to a first length-wise end of the substrate than the second resistive trace and a first length-wise end of the first resistive trace being closer to the first length-wise end of the substrate than the third thermistor.

Having a distinct thermistor for each resistive trace allows for the resistive traces to be independently controlled for achieving high speed fusing with reduced flicker and harmonic noise. In an example embodiment, the first resistive trace is used for low speed printing and both resistive traces are used for high speed printing.

BRIEF DESCRIPTION OF THE DRAWINGS

The above-mentioned and other features and advantages of the disclosed example embodiments, and the manner of attaining them, will become more apparent and will be better understood by reference to the following description of the disclosed example embodiments in conjunction with the accompanying drawings, wherein.

DETAILED DESCRIPTION

Figure 1:
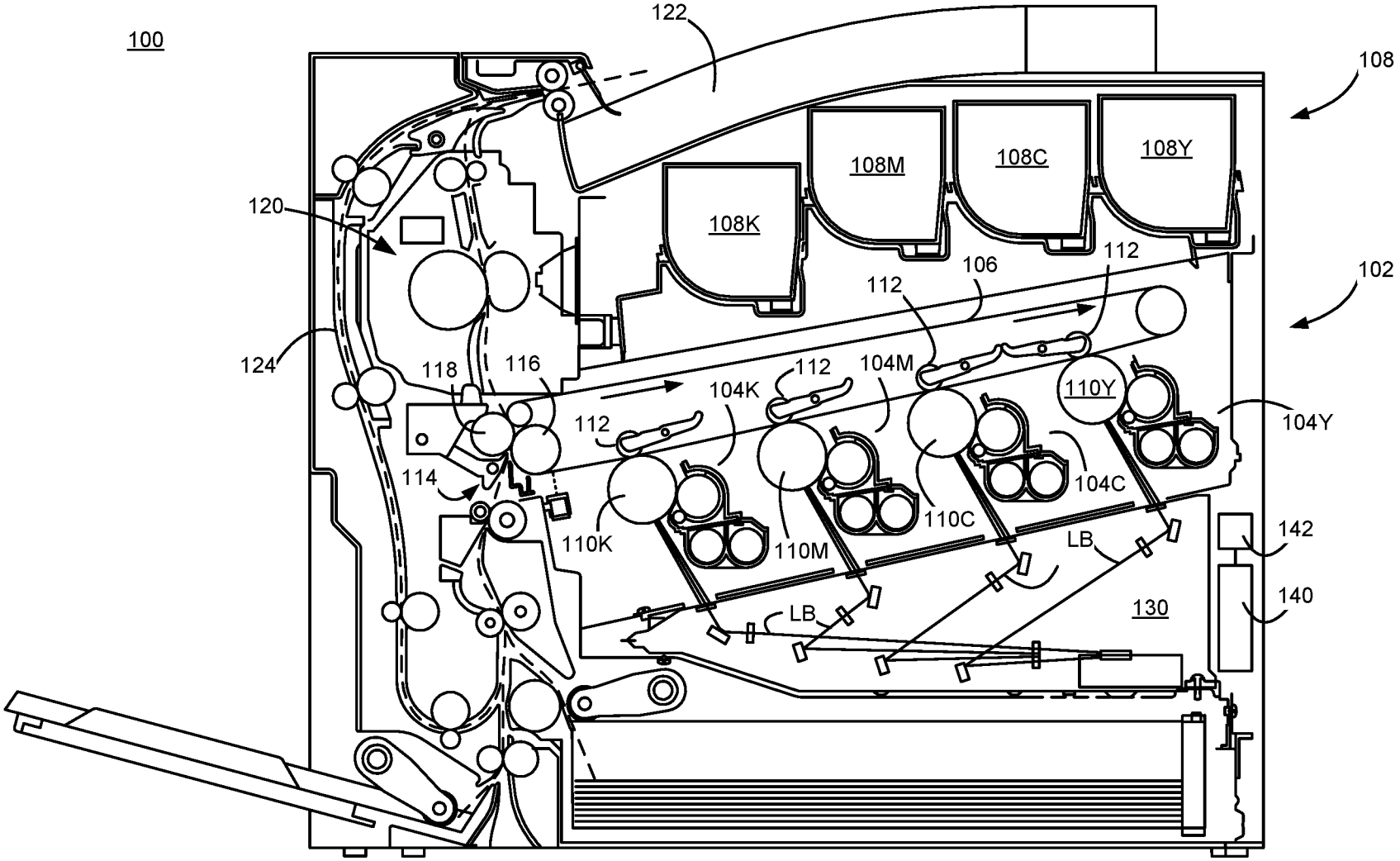
FIG. 1 is a side elevational view of an imaging device according to an example embodiment.

It is to be understood that the present disclosure is not limited in its application to the details of construction and the arrangement of components set forth in the following description or illustrated in the drawings. The present disclosure is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and positionings. In addition, the terms "connected" and "coupled" and variations thereof are not restricted to physical or mechanical connections or couplings.

Spatially relative terms such as "top", "bottom", "front", "back" and "side", and the like, are used for ease of description to explain the positioning of one element relative to a second element. Terms such as "first", "second", and the like, are used to describe various elements, regions, sections, etc. and are not intended to be limiting. Further, the terms "a" and "an" herein do not denote a limitation of quantity, but rather denote the presence of at least one of the referenced item.

Furthermore, and as described in subsequent paragraphs, the specific configurations illustrated in the drawings are intended to exemplify embodiments of the disclosure and that other alternative configurations are possible.

Reference will now be made in detail to the example embodiments, as illustrated in the accompanying drawings. Whenever possible, the same reference numerals will be used throughout the drawings to refer to the same or like parts.

FIG. 1 illustrates a color imaging device 100 according to an example embodiment. Imaging device 100 includes a first toner transfer area 102 having four developer units 104 that substantially extend from one end of imaging device 100 to an opposed end thereof. Developer units 104 are disposed along an intermediate transfer member (ITM) 106. Each developer unit 104 holds a different color toner. The developer units 104 may be aligned in order relative to the direction of the ITM 106 indicated by the arrows in FIG. 1, with the yellow developer unit 104Y being the most upstream, followed by cyan developer unit 104C, magenta developer unit 104M, and black developer unit 104K being the most downstream along ITM 106.

Each developer unit 104 is operably connected to a toner reservoir 108 (108K, 108M, 108C and 108Y) for receiving toner for use in a printing operation. Each toner reservoir 108 is controlled to supply toner as needed to its corresponding developer unit 104. Each developer unit 104 is associated with a photoconductive member 110 that receives toner therefrom during toner development to form a toned image thereon. Each photoconductive member 110 is paired with a transfer member 112 for use in transferring toner to ITM 106 at first transfer area 102.

During color image formation, the surface of each photoconductive member 110 is charged to a specified voltage, such as −800 volts, for example. At least one laser beam LB from a printhead or laser scanning unit (LSU) 130 is directed to the surface of each photoconductive member 110 and discharges those areas it contacts to form a latent image thereon. In one embodiment, areas on the photoconductive member 110 illuminated by the laser beam LB are discharged to approximately −100 volts. The developer unit 104 then transfers toner to photoconductive member 110 to form a toner image thereon. The toner is attracted to the areas of the surface of photoconductive member 110 that are discharged by the laser beam LB from LSU 130.

ITM 106 is disposed adjacent to each of developer unit 104. In this embodiment, ITM 106 is formed as an endless belt disposed about a drive roller and other rollers. During image forming or imaging operations, ITM 106 moves past photoconductive members 110 in a clockwise direction as viewed in FIG. 1. One or more of photoconductive members 110 applies its toner image in its respective color to ITM 106. For mono-color images, a toner image is applied from a single photoconductive member 110K. For multi-color images, toner images are applied from two or more photoconductive members 110. In one embodiment, a positive voltage field formed in part by transfer member 112 attracts the toner image from the associated photoconductive member 110 to the surface of moving ITM 106.

ITM 106 rotates and collects the one or more toner images from the one or more developer units 104 and then conveys the one or more toner images to a media sheet at a second transfer area 114. Second transfer area 114 includes a second transfer nip formed between at least one back-up roller 116 and a second transfer roller 118.

Fuser assembly 120 is disposed downstream of second transfer area 114 and receives media sheets with the unfused toner images superposed thereon. In general terms, fuser assembly 120 applies heat and pressure to the media sheets in order to fuse toner thereto. After leaving fuser assembly 120, a media sheet is either deposited into output media area 122 or enters duplex media path 124 for transport to second transfer area 114 for imaging on a second surface of the media sheet.

Imaging device 100 is depicted in FIG. 1 as a color laser printer in which toner is transferred to a media sheet in a two-step operation. Alternatively, imaging device 100 may be a color laser printer in which toner is transferred to a media sheet in a single-step process—from photoconductive members 110 directly to a media sheet. In another alternative embodiment, imaging device 100 may be a monochrome laser printer which utilizes only a single developer unit 104 and photoconductive member 110 for depositing black toner directly to media sheets. Further, imaging device 100 may be part of a multi-function product having, among other things, an image scanner for scanning printed sheets.

Imaging device 100 further includes a controller 140 and memory 142 communicatively coupled thereto. Though not shown in FIG. 1, controller 140 may be coupled to components and modules in imaging device 100 for controlling same. For instance, controller 140 may be coupled to toner reservoirs 108, developer units 104, photoconductive members 110, fuser assembly 120 and/or LSU 130 as well as to motors (not shown) for imparting motion thereto. It is understood that controller 140 may be implemented as any number of controllers and/or processors for suitably controlling imaging device 100 to perform, among other functions, printing operations.

Figure 2:
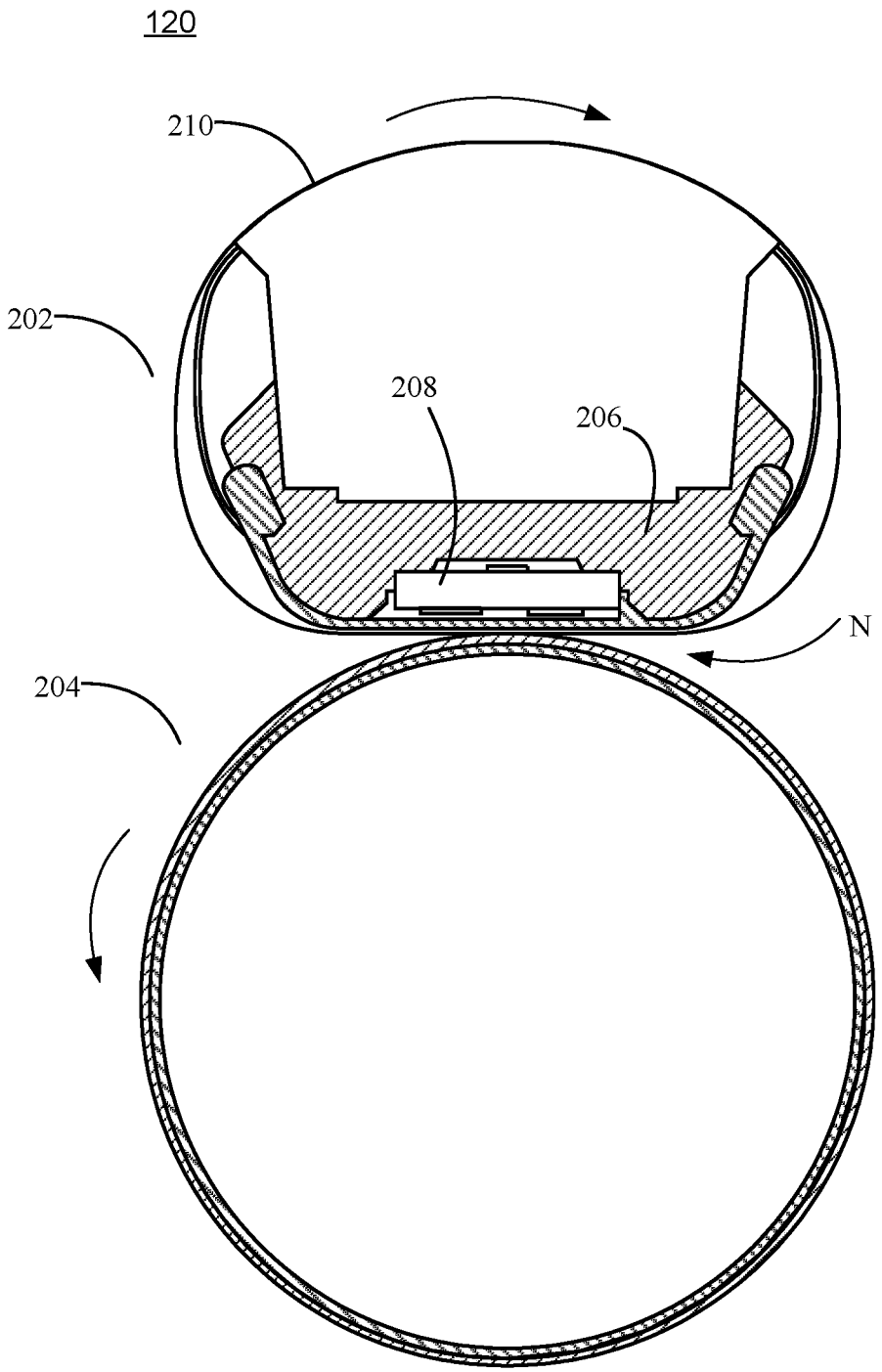
FIG. 2 is a cross sectional view of a fuser assembly of the imaging device of FIG. 1.

With respect to FIG. 2, in accordance with an example embodiment, there is shown fuser assembly 120 for use in fusing toner to sheets of media through application of heat and pressure. Fuser assembly 120 may include a heat transfer member 202 and a backup roll 204 cooperating with the heat transfer member 202 to define a fuser nip N for conveying media sheets therein. The heat transfer member 202 may include a housing 206, a heater member 208 supported on or at least partially in housing 206, and an endless flexible fuser belt 210 positioned about housing 206. Heater member 208 may be formed from a substrate of ceramic or like material to which at least one resistive trace is secured which generates heat when a current is passed through it. The inner surface of fuser belt 210 contacts the outer surface of heater member 208 so that heat generated by heater member 208 heats fuser belt 210. Heater member 208 may further include at least one temperature sensor, such as a thermistor, coupled to the substrate for detecting a temperature of heater member 208.

Fuser belt 210 is disposed around housing 206 and heater member 208. Backup roll 204 contacts fuser belt 210 such that fuser belt 210 rotates about housing 206 and heater member 208 in response to backup roll 204 rotating. With fuser belt 210 rotating around housing 206 and heater member 208, the inner surface of fuser belt 210 contacts heater member 208 so as to heat fuser belt 210 to a temperature sufficient to perform a fusing operation to fuse toner to sheets of media.

Fuser belt 210 and backup roll 204 may be largely constructed from the elements and in the manner as disclosed in U.S. Pat. No. 7,235,761, which is assigned to the assignee of the present application and the content of which is incorporated by reference herein in its entirety.

Figure 3:
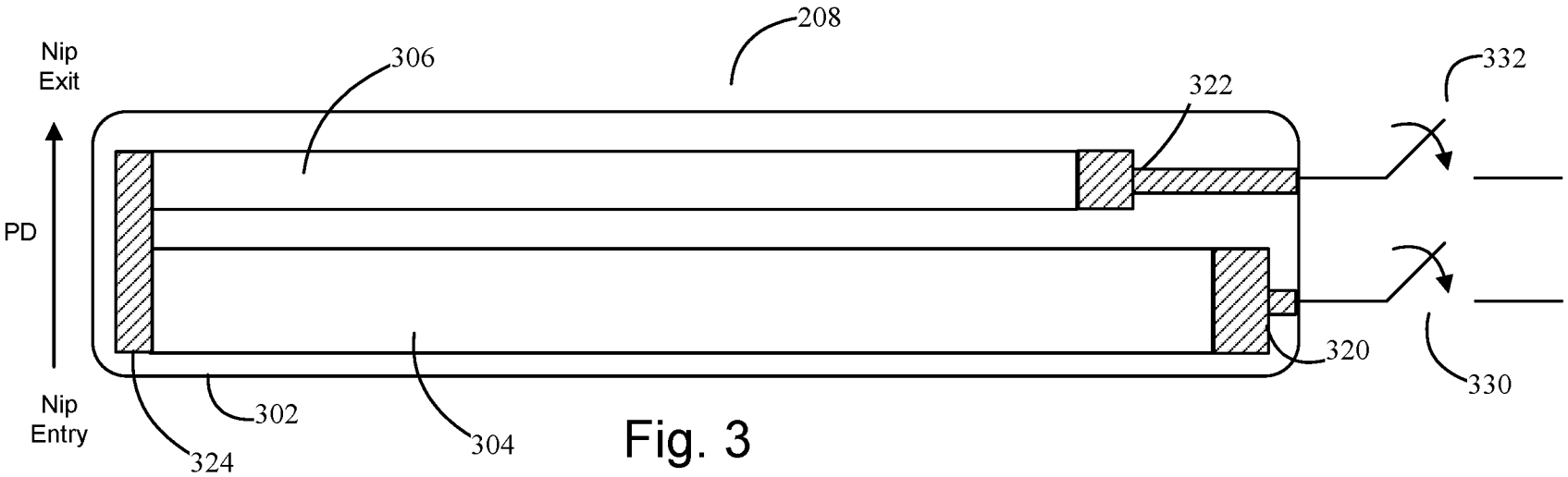
FIGS. 3 and 4 are bottom and top views, respectively, of a heater device of the fuser assembly of FIG. 2, according to an example embodiment.
Figure 4:
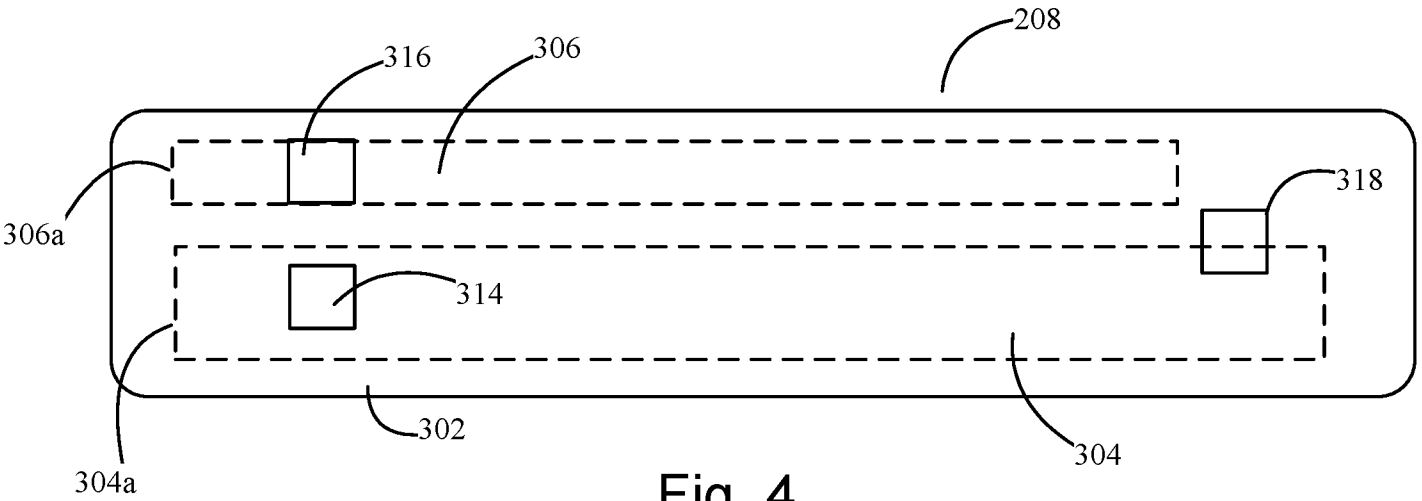

In accordance with example embodiments, fuser assembly 120 provides for effective toner fusing at high speeds with reduced flicker and harmonics effects. FIGS. 3 and 4 show heater member 208 according to an example embodiment for a reference-edge based media feed system in which the media sheets are aligned in the media feed path of imaging device 100 using an edge of each sheet. Heater member 208 includes a substrate 302 constructed from ceramic or other like material. Disposed on a bottom surface of substrate 302 in parallel relation with each other are two resistive traces 304 and 306. Resistive trace 304 is disposed on the entry side of fuser nip N and resistive trace 306 is disposed on the exit side of fuser nip N so that the process direction PD of fuser assembly 120 is illustrated in FIG. 3. The length of resistive trace 304 is comparable to the width of a Letter sized sheet of media and is disposed on substrate 302 for fusing toner to letter sized sheets. The length of resistive trace 306 is comparable to the width of A4 sized sheet of media and is disposed on substrate 302 for fusing toner to A4 sized sheets. In an example embodiment, the width of resistive trace 304 is larger than the width of resistive trace 306 in order to have different heating zone requirements for different print speeds. In an example embodiment, the width of resistive trace 304 is between about 4.5 mm and about 5.5 mm, such as 5 mm, and the width of resistive trace 306 is between about 2.0 mm and about 2.50 mm, such as 2.25 mm. In general terms, the width of resistive trace 304 is between about two and about three times the width of resistive trace 306. By having such a difference in trace widths, and with the resistivity of resistive trace 304 being substantially the same as the resistivity of resistive trace 304 such that the resistance of trace 304 is less than the resistance of trace 306, resistive trace 304 may be used for lower printing speeds and both resistive traces 304 and 306 may be used for relatively high printing speeds. The use of the heater member 208 will be described in greater detail below.

In another embodiment, the widths of resistive traces 304 and 306 are substantially the same but the resistivity of resistive trace 304 is less than the resistivity of 306. In another embodiment, the width and resistivity of resistive trace 304 is different from the width and resistivity of trace 306 so that the resistance of trace 304 is less than the resistance of trace 306.

Heater member 208 further includes conductors coupled to resistive traces 304 and 306. Referring again to FIG. 3, conductor 320 is connected to one length-wise end of resistive trace 304, and conductor 322 is connected to a length-wise end of resistive trace 306. At the opposite length-wise end of substrate 302, conductor 324 is connected between and thus electrically shorts together the second length-wise ends of resistive traces 304 and 306.

Fuser assembly 120 further includes switches for use in selectively providing current to resistive traces 304 and 306. Switch 330 is coupled to conductor 320 and switch 332 is coupled to conductor 322. Switches 330 and 332 may be located in, for example, a power supply of imaging device 100 (not shown). In an example embodiment, switches 330 and 332 are triacs.

A plurality of thermistors are disposed on a top surface of substrate 302. Referring to FIG. 4, thermistor 314 is disposed on the top surface of substrate 302 opposite an area of resistive trace 304 (shown in dashed lines in FIG. 4) near the length-wise end 304*a* of resistive trace 304 that corresponds to the reference edge of a sheet of media passing through fuser nip N. Similarly, thermistor 316 is disposed on the top surface of substrate 302 opposite resistive trace 306 (also in dashed lines) near the length-wise end 306*a* of resistive trace 306 that corresponds to the reference edge of the sheet of media. In an example embodiment, thermistor 314 is about 1.5 inches from end 304*a* of resistive trace 304, and thermistor 316 is about 1.5 inches from end 306*a* of resistive trace 306. It is understood, however, that thermistors 314 and 316 may be disposed at a distance from resistive trace ends 304*a* and 306*a*, respectively, that is greater or less than 1.5 inches. A third thermistor, thermistor 318, is disposed on the top surface of substrate 302 opposite an area of heater member 208 that does not contact A4 media but contacts Letter sized media. By having a thermistor disposed opposite and thus correspond to each resistive trace 304, 306, resistive traces 304, 306 may be independently controlled so that heater member 208 achieves a more uniform temperature profile from nip entry to nip exit of fuser nip N.

Specifically, the use of feedback from a single thermistor has been seen to be too slow to prevent heater crack because there is sizeable temperature gradient across the width of heater member 208 and a sizeable temperature profile change during the time heater member 208 is warming up. Besides preventing heater member 208 from cracking, each resistor trace 304, 306 having its own thermistor makes it possible to achieve a substantially uniform temperature profile across the width of heater member 208 during printing. When a media sheet passes through fuser nip N, it creates a sizeable thermal load difference from entry side to exit side due to a dramatic paper temperature increase inside fuser nip N. At the entry side of fuser nip N, media sheet temperature is close to room temperature and it absorbs more heat. When the sheet reaches the exit side of fuser nip N, sheet temperature is higher than 100 degree C. and the sheet absorbs much less heat than that at the entry side of fuser nip N. As a result, the thermal load difference between nip entry and nip exit makes the temperature of heater member 208 at its exit side significantly hotter than the temperature at the entry side. To compensate the thermal load difference between media sheet entry and exit and achieve a substantially uniform temperature profile across the width of heater member 208 for nearly all possible fusing conditions, each resistor trace 304, 306 has its own temperature feedback so that closed loop control can be performed.

In an example embodiment, resistive traces 304, 306 have different power levels. Total power of heater member 208 is specified by consideration of fusing speed, nip width, flicker, and harmonics. The power difference between resistive traces 304 and 306 results in reducing flicker and harmonics. If the power difference of resistive traces 304 and 306 is designed to be too large, sizeable load variations result during power stepping up and stepping down during fusing. As a result, too large of a power difference between resistive traces 304 and 306 will make light flicker worse. In order to reduce the flicker, phase control has previously been used to provide some intermediate power levels so that a reasonable power level change during stepping up and stepping down of power of heater member 208 can be achieved. As a result, harmonics wave noise will worsen because phase control is used. On the other hand, if the power difference between resistive traces 304 and 306 is too small, more than two resistive traces may be needed to achieve a small amount of power increments and decrements during the step up and step down when heating and cooling heater member 208 during a fusing operation. More resistive traces, however, will add more cost for control and also make it very difficult to place all resistor traces inside the fuser nip. In an effort to avoid too large and too small of a power difference, in an example embodiment, resistive trace 304 has a power level of about 1000 W and resistive trace 306 has a power level of about 450 W.

An advantage of two independently-controlled resistor traces 304 and 306 is that heater member 208 can deliver four different power levels such as 0 W, 450 W, 1000 W, and 1450 W without using phase control. During heating and cooling of heater member 208, controller 140 can gradually step up and step down heating power for heater member 208. Instead of stepping directly from zero power to full power and from full power to zero power during printing, as seen in existing approaches that utilize a fuser member having a single resistive trace, the power of heater member 208 utilizing two resistive traces 304, 306 is gradually stepped up from zero to 450 W, and then to 1000 W, and eventually to 1450 W and gradually stepped down from 1450 W to 1000 W, then 1000 W to 450 W, and then from 450 W to zero power within a relatively short time period. Carefully selected power levels for step up and step down power transitions during fusing operations are seen to significantly reduce the severity of light flicker without using phase control. Since phase control is not used during stepping up and stepping down power of fuser member 208, fuser member 208 will generate reduced or otherwise negligible harmonic wave noise. As a result, heater member 208 having to dual resistive traces 304 and 306 makes it much easier for heater member 208 to operate at relatively high power while meeting IEC flicker and harmonics requirements.

The widths of resistive traces 304 and 306 of heater member 208 are also a factor in reducing or eliminating flicker and harmonics. Flicker and harmonics are directly related to heating power. Higher heating power will generate more flicker and harmonics than lower heating power. Since media sheets have a longer residence time in fuser nip N at low speeds and fusing at low speeds requires a narrower heating zone, the use of both resistive traces 304 and 306 during fusing provides a wider heating zone and so is only used for high speed fusing, and a single resistive trace 304 or 306 is used for low speed fusing because the single resistive trace 304 or 306 generates less flicker and harmonics due to lower heating power. To meet desired heating zones at different speeds and also to keep resistive traces 304 and 306 inside the width of fuser nip N, the width resistive trace 304 used for both low and high speed fusing is first designed wide enough to satisfy the heating zone requirement of low speed and the width of resistive trace 306, used together with resistive trace 304 for high speed, is configured so that both resistive traces 304 and 306 can provide a wider heating zone to meet high speed heating zone requirements and also can be placed inside fuser nip N under all possible tolerance conditions. Since only a single resistor trace 304 or 306 is used for low speed, heater member 208 will generate less flicker and harmonics at low speed.

Figure 5:
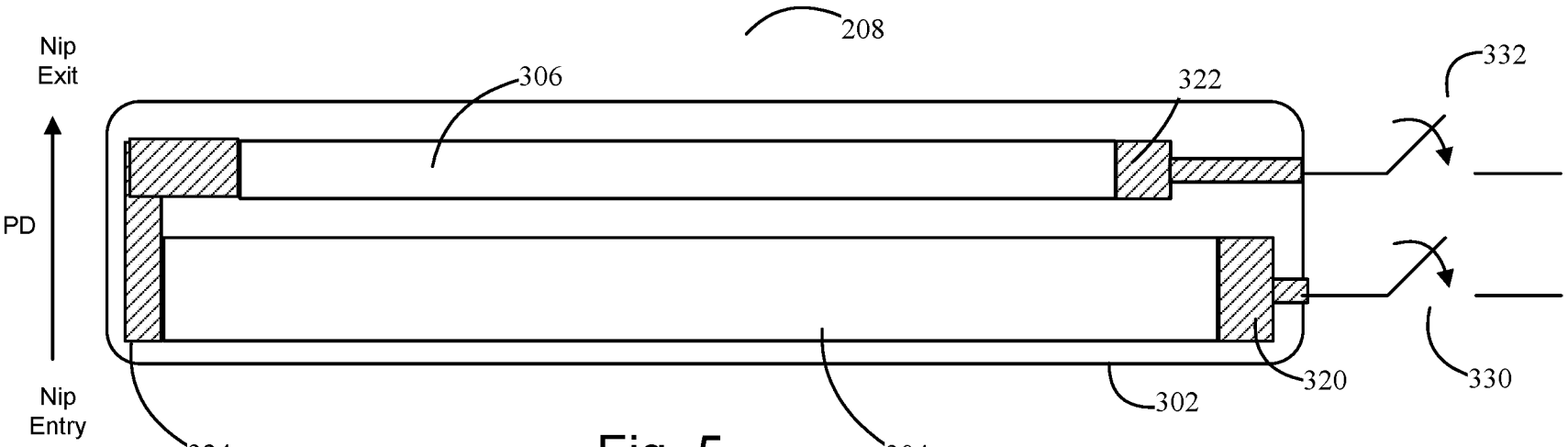
FIGS. 5 and 6 are bottom and top views, respectively, of a heater device of the fuser assembly of FIG. 2, according to another example embodiment.
Figure 6:
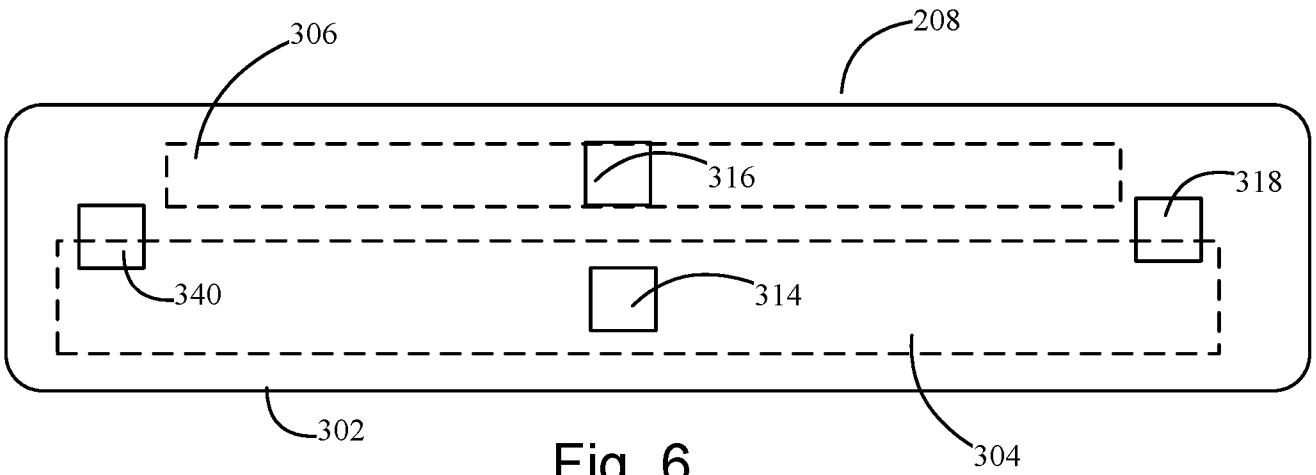

FIGS. 5 and 6 illustrate heater member 208 according to another example embodiment for a center-reference based media feed system in which the media sheets are aligned in the lateral center of the media feed path of imaging device 100. Heater member 208 of FIGS. 5 and 6 are configured for an imaging device 100 having a center-referenced media transport system. Here, resistive traces 304 and 306 are centered in the length-wise direction along substrate 302. In addition, a fourth thermistor 340 is disposed on the opposite length-wise end of substrate 302 so as to be able to detect the temperature of heater member 208 just beyond the area covered by resistive trace 306 (corresponding to an A4 sized width).

Figure 7:
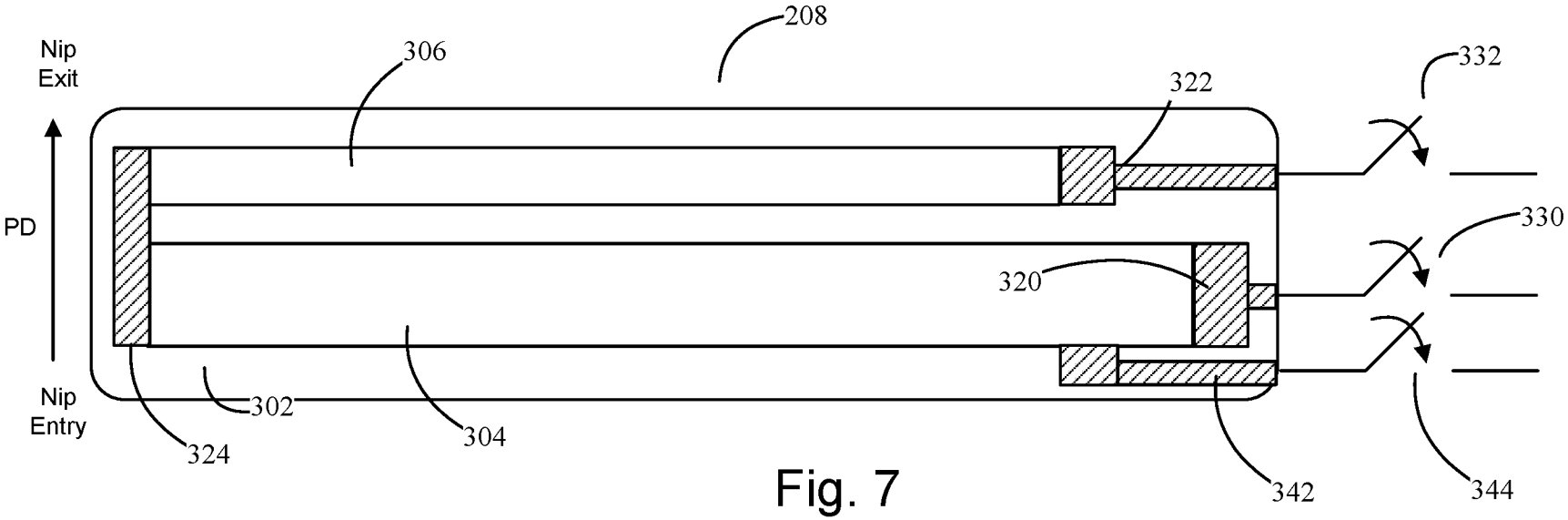
FIGS. 7 and 8 are bottom and top views, respectively, of a heater device of the fuser assembly of FIG. 2, according to still another example embodiment.
Figure 8:
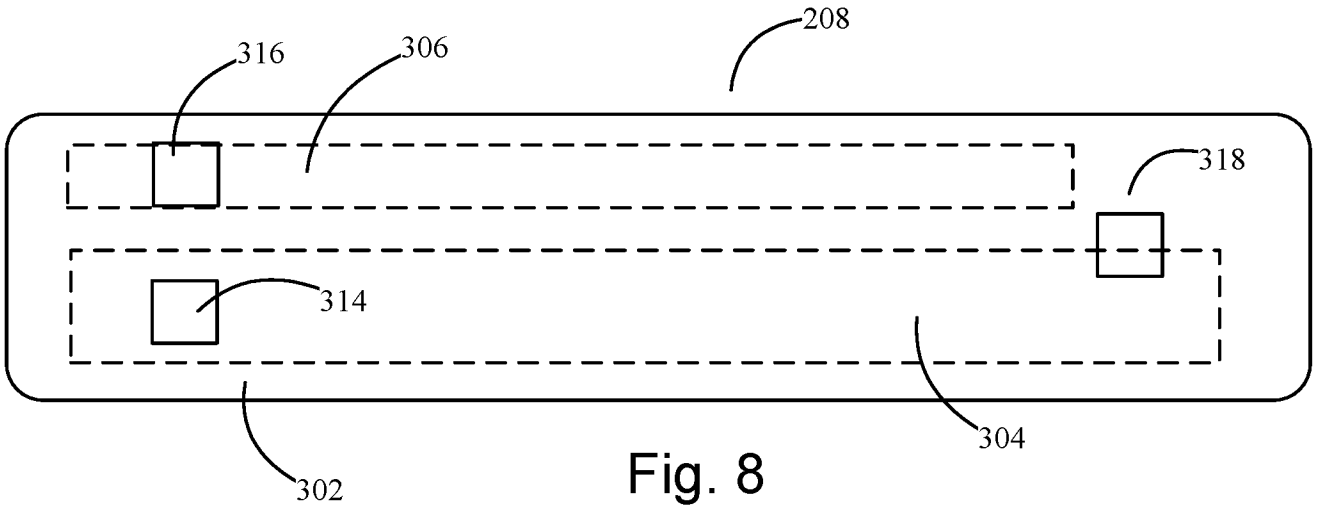

FIGS. 7 and 8 illustrate heater member 208 for a reference-edge based media feed system having much of the same structure as heater member 208 of FIGS. 3 and 4. In addition, heater member 208 includes conductor 342 which is connected to resistive trace 304 at a location corresponding to a length-wise end of resistive trace 306. In addition, a switch 344 is coupled to conductor 342 so as to selectively provide current through resistive trace 304 between conductor 324 and conductor 342. The use of conductor 342 and switch 344 allows for controller 140 to open switch 330 and close switch 342 during a fusing operation for A4 sized media so as to lessen the amount of heat in the region of heater member 208 just beyond the end of resistive trace 306 which is not contacted by the A4 sized media sheets.

Figure 9:
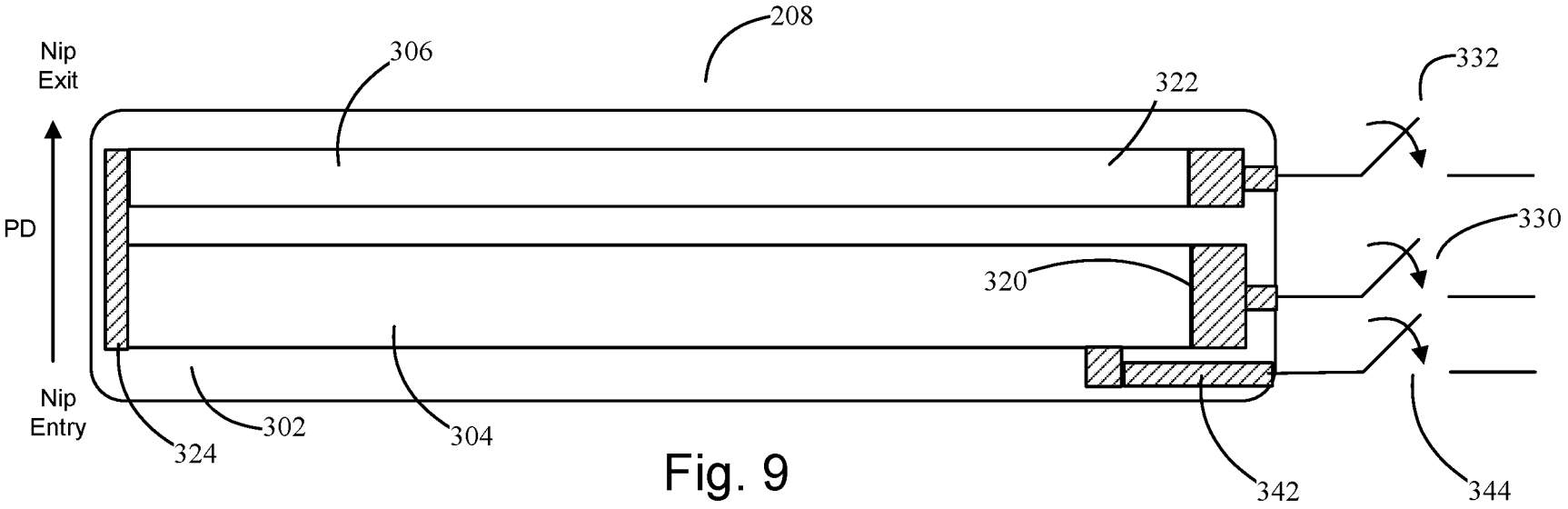
FIGS. 9 and 10 are bottom and top views, respectively, of a heater device of the fuser assembly of FIG. 2, according to another example embodiment.
Figure 10:
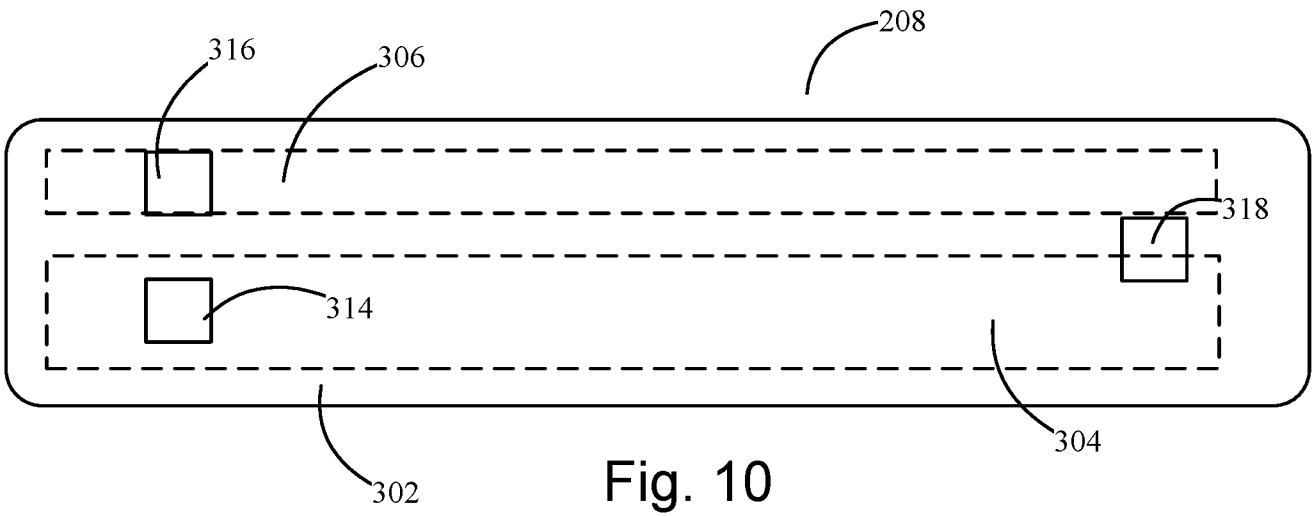
Figure 11:
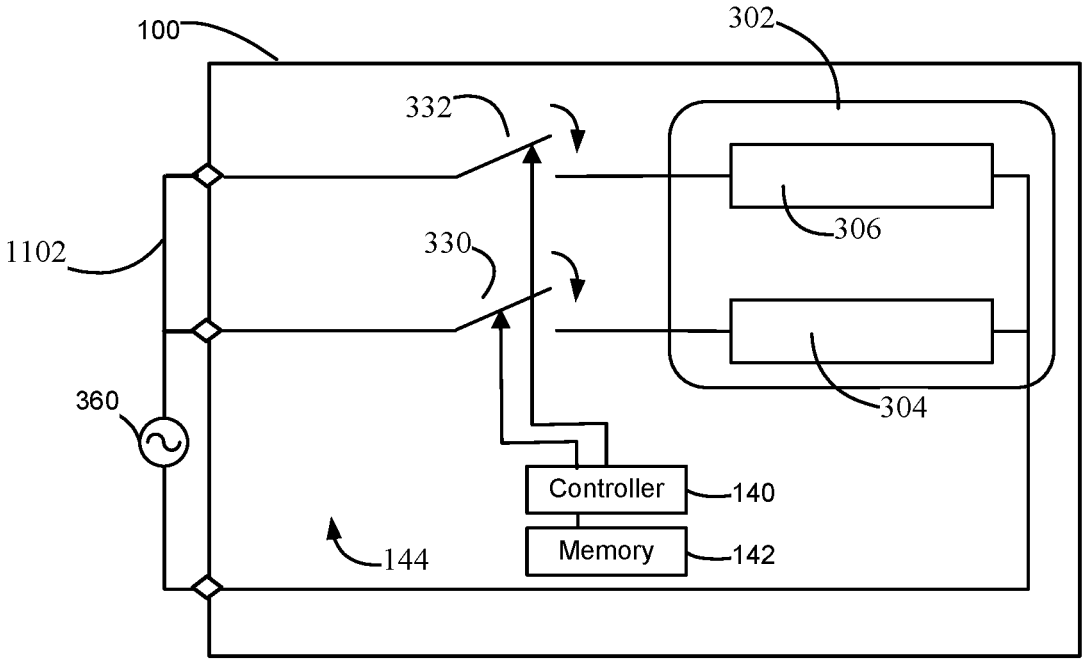
FIG. 11 is a simplified fuser heater control diagram for a fuser heater according to another example embodiment.

FIGS. 9 and 10 illustrate heater member 208 for a reference-edge based media feed system according to another example embodiment. Heater member 208 of FIGS. 9 and 10 has much of the same structure of heater member 208 of FIGS. 7 and 8. However, resistive trace 306 in FIGS. 9 and 10 is longer than the length of resistive trace 306 in FIGS. 7 and 8. Resistive trace 306 has a length that is substantially the same as the length of resistive trace 304, which corresponds to the width of a Letter sized sheet of media. Heater member 208 of FIGS. 8 and 9 allows for edge to edge printing FIG. 11 illustrates imaging device 100 coupled to an AC power source 360. Within imaging device 100, AC line 1102 is coupled to switches 330 and 332 for providing power thereto.

As can be seen, controller 140 controls switches 330 and 332 for controlling the current passing through, and hence the power level of, each resistive traces 304 and 306.

Figure 12:
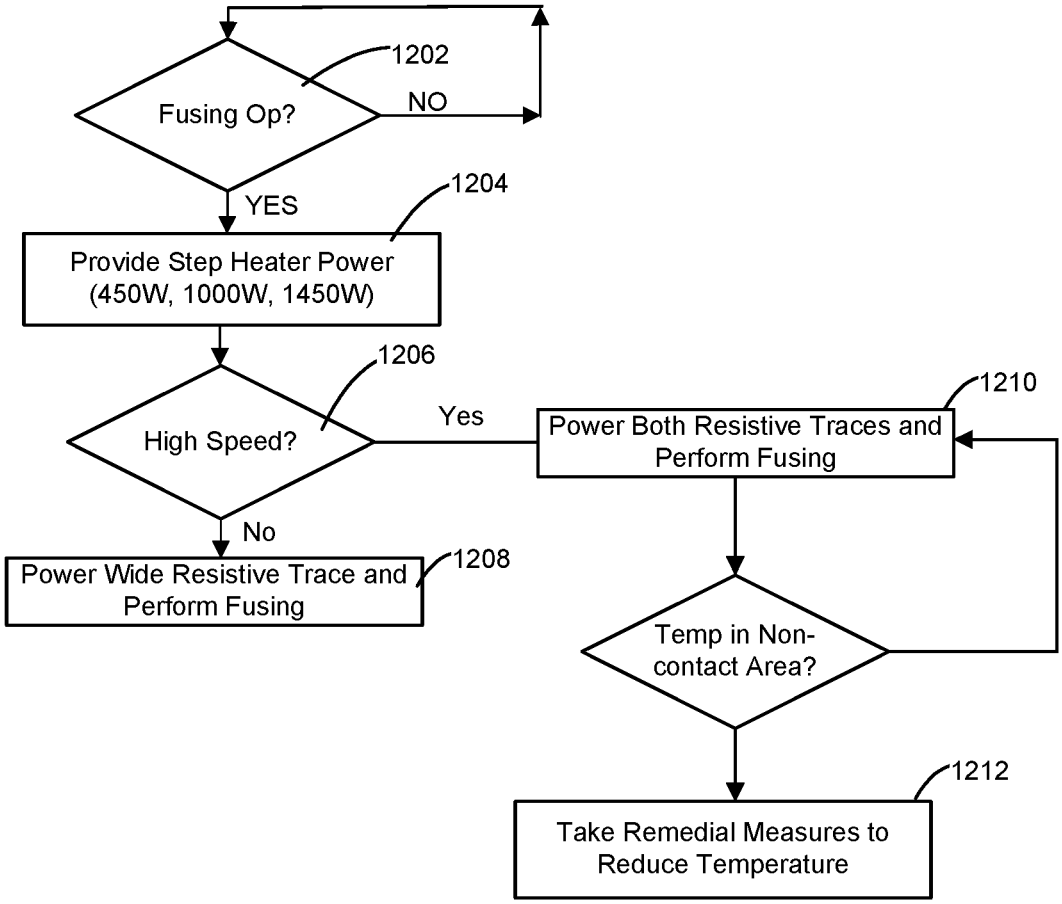
FIG. 12 is a flowchart illustrating a method of operating the heater devices of FIGS. 3-10, according to an example embodiment.

The operation of heater member 208 will be described with reference to FIG. 12. Upon controller 140 determining at 1202 that a fuser (printer) operation is to be performed, controller 140 warms up heater member 208 by gradually stepping power therefor at 1204.

Specifically, controller 140 steps heater power from zero to 450 W through resistive trace 306, then steps power from 450 W to 1000 W through resistive trace 304, and then steps power from 1000 W to 1450 W through both resistive traces 304 and 306. When heater member 208 reaches a fusing temperature, controller 140 determines at 1206 whether the fusing (print) operation is to be at high speed or a lower speed. If the fusing (print) operation is to be at a lower speed, resistive trace 304 is powered at 1208 and fusing is performed. It is noted that even in fusing A4 sized sheets of media, because the fusing (printing) speed is low, the region of heater member 208 which does not contact the A4 sheets do not increase in temperature above a predetermined maximum amount.

If the fusing (print) operation is at a high speed, such as the rated speed of imaging device 100, then both resistive traces 304 and 306 are powered at 1210. Then, during the fusing (printing), if the media sheets are A4 sized sheets, a region of heater member 208 just beyond the length-wise end of resistive trace 306 may increase in temperature beyond a predetermined amount corresponding to a maximum allowed temperature for heater member 208. In response, controller 140 may take steps at 1212 to reduce the temperature of such region of heater member 208. For example, controller 140 may reconfigure power levels in resistive traces 304 and 306. For heater member 208 of FIGS. 3 and 4, controller 140 may change the power levels in resistive traces 304 and 306. For heater member 208 of FIGS. 7 and 8, controller 140 may open switch 330 and close switch 344 so that there is no heating in the region just beyond the length-wise end of resistive trace 306 (i.e., the region where A4 media sheets do not contact heater member 208). For heater member 208 of FIGS. 9 and 10, controller 140 may similarly open switch 330 and close switch 344 so that there is no heating in the region just beyond region of heater member 208 which does not contact A4 sheets of media.

The example embodiments above are described above as controller 140 being separate from but communicatively coupled to fuser assembly 120 on the imaging device. In an alternative embodiment, controller 140 is mounted on or within fuser assembly 120 and may form part thereof.

The description of the details of the example embodiments have been described in the context of a color electrophotographic imaging devices. However, it will be appreciated that the teachings and concepts provided herein are applicable to monochrome electrophotographic imaging devices and multifunction products employing electrophotographic imaging.

The foregoing description of several example embodiments of the invention has been presented for purposes of illustration. It is not intended to be exhaustive or to limit the invention to the precise steps and/or forms disclosed, and obviously many modifications and variations are possible in light of the above teaching. It is intended that the scope of the invention be defined by the claims appended hereto.

The invention claimed is:

1. A toner fusing apparatus, comprising:

a substrate having a first surface and a second surface, the second surface being opposite the first surface on the substrate;

a plurality of resistive traces disposed along the first surface of the substrate, comprising a first resistive trace and a second resistive trace, the first and second resistive traces being disposed adjacent each other along the first surface of the substrate in a length-wise direction thereof, a resistance of the first resistive trace being less than a resistance of the second resistive trace; and a plurality of thermistors disposed along the second surface of the substrate, comprising a first thermistor disposed on the second surface of the substrate opposite a first location of the first resistive trace, a second thermistor disposed on the second surface of the substrate opposite a first location of the second resistive trace, and a third thermistor disposed on the second surface of the substrate, the third thermistor being closer to a first length-wise end of the substrate than the second resistive trace and a first length-wise end of the first resistive trace being closer to the first length-wise end of the substrate than the third thermistor.

2. The toner fusing apparatus of claim 1, further comprising a plurality of conductive members, comprising a first conductive member coupled to the first length-wise end of the first resistive trace, a second conductive member coupled to a first length-wise end of the second resistive trace and a third conductive member coupled to a second length-wise end of the first resistive trace and a second length-wise end of the second resistive trace.

3. The toner fusing apparatus of claim 2, further comprising a first switch coupled to the first conductive member and a second switch coupled to the second conductive member.

4. The toner fusing apparatus of claim 3, further comprising a controller coupled to the first switch and the second switch, the controller configured to close the first and second switches during a first fusing operation at a first speed, and to close the first switch and open the second switch during a fusing operation at a second speed less than the first speed.

5. The toner fusing apparatus of claim 4, wherein the controller is coupled to the first, second and third thermistors for receiving signals therefrom.

6. The toner fusing apparatus of claim 2, wherein the second length-wise end of the first resistive trace is closer to a second length-wise end of the substrate than the second length-wise end of the second resistive trace.

7. The toner fusing apparatus of claim 6, further comprising a fourth thermistor disposed on the second surface of the substrate opposite a location on the first surface of the substrate that is closer to the second length-wise end of the substrate than the second length-wise end of the second resistive trace but farther to the second length-wise end of the substrate than the second length-wise end of the first resistive trace.

8. The toner fusing apparatus of claim 2, wherein a distance from the second length-wise end of the first resistive trace to a second length-wise end of the substrate is substantially the same as a distance from the second length-wise end of the second resistive trace to the second end of the substrate.

9. The toner fusing apparatus of claim 2, further comprising a fourth conductive member coupled to the first resistive trace at a location that is a distance to the first length-wise end of the substrate which is substantially the same as a distance of the first length-wise end of the second resistive trace to the first length-wise end of the substrate.

10. The toner fusing apparatus of claim 9, further comprising a first switch coupled to the first conductive member, a second switch coupled to the second conductive member and a third switch coupled to the fourth conductive member.

11. The toner fusing apparatus of claim 1, wherein a width of the first resistive trace is at least twice a width of the second resistive trace.

12. The toner fusing apparatus of claim 1, wherein the first location of the first resistive trace is near a second length-wise end of the first resistive trace and the first location of the second resistive trace is near a first length-wise end of the second resistive trace.

13. The toner fusing apparatus of claim 1, wherein the first location of the first resistive trace is in a central area along the length of the first resistive trace, and the first location of the second resistive trace is in a central area along the length of the second resistive trace.

14. The toner fusing apparatus of claim 1, wherein the first location of the first resistive trace is about 1.5 inches from a second length-wise end of the first resistive trace, and the first location of the second resistive trace is about 1.5 inches from a first length-wise end of the second resistive trace.

15. A toner fusing apparatus, comprising:

a substrate having a first surface and a second surface, the second surface being opposite the first surface on the substrate;

a plurality of resistive traces disposed along the first surface of the substrate, comprising a first resistive trace and a second resistive trace, the first and second resistive traces being disposed adjacent each other along the first surface of the substrate in a length-wise direction thereof, a length of the first resistive trace being greater than a length of the second resistive trace; and a plurality of thermistors disposed along the second surface of the substrate, comprising a first thermistor disposed on the second surface of the substrate opposite a first location of the first resistive trace, a second thermistor disposed on the second surface of the substrate opposite a first location of the second resistive trace, and a third thermistor disposed on the second surface of the substrate, the third thermistor being closer to a first length-wise end of the substrate than the second resistive trace and a first length-wise end of the first resistive trace being closer to the first length-wise end of the substrate than the third thermistor.

16. The toner fusing system of claim 15, further comprising a controller coupled to the resistive traces and to the plurality of thermistors, the controller configured to control current passing through the first resistive trace and the second resistive trace independently of each other.

* * * * *